US009450363B2

(12) United States Patent
Ghosh et al.

(10) Patent No.: US 9,450,363 B2
(45) Date of Patent: Sep. 20, 2016

(54) MODULAR POWER ADAPTOR WITH A BASE MODULAR UNIT HAVING PLURALITY OF SURFACE CONNECTORS FOR CONNECTION TO A POWER SOURCE

(71) Applicant: INTEL CORPORATION, Santa Clara, CA (US)

(72) Inventors: Prosenjit Ghosh, Portland, OR (US); John J. Valavi, Hillsboro, OR (US); Ajay V. Bhatt, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 333 days.

(21) Appl. No.: 14/040,317

(22) Filed: Sep. 27, 2013

(65) Prior Publication Data

US 2015/0093937 A1 Apr. 2, 2015

(51) Int. Cl.
*H01R 31/06* (2006.01)

(52) U.S. Cl.
CPC ..... *H01R 31/065* (2013.01); *H01R 2201/06* (2013.01)

(58) Field of Classification Search
CPC ..... H01R 31/065; H01R 2201/06
USPC ..... 710/9, 10, 34, 62, 67, 303
See application file for complete search history.

(56) References Cited

U.S. PATENT DOCUMENTS

| | | | | |
|---|---|---|---|---|
| 6,700,773 | B1 * | 3/2004 | Adriaansen | G06F 1/1618 345/156 |
| 7,865,639 | B2 * | 1/2011 | McCoy | F25D 23/12 320/104 |
| 8,539,114 | B2 * | 9/2013 | Zawacki | G06F 13/102 345/104 |
| 2006/0030956 | A1 * | 2/2006 | Kumar | G06F 1/1626 700/66 |
| 2006/0104017 | A1 * | 5/2006 | Chang | G06F 1/1632 361/679.41 |
| 2010/0033403 | A1 * | 2/2010 | Liao | G06F 3/147 345/2.1 |
| 2011/0276885 | A1 * | 11/2011 | Gibson | H04N 7/147 715/734 |

* cited by examiner

*Primary Examiner* — Tammara Peyton
(74) *Attorney, Agent, or Firm* — KED & Associates LLP

(57) ABSTRACT

An adaptor may include a base modular unit that includes a plurality of surface connectors, a first port and circuitry. At least one surface connector may couple to an expansion modular unit. Circuitry or logic may provide information from the first port to the at least one surface connector.

23 Claims, 6 Drawing Sheets

MODULAR POWER ADAPTOR WITH A BASE MODULAR UNIT HAVING PLURALITY OF SURFACE CONNECTORS FOR CONNECTION TO A POWER SOURCE

BACKGROUND

1. Field

Embodiments may relate to a modular power adaptor (or modular adaptor) for an electronic device.

2. Background

Electronic devices, such as laptop computers, are becoming thinner. Users may desire to plug more and more different types of external devices into the electronic devices. For example, a user may desire to plug any one of an input/output (I/O) device, a connector, a memory card, a peripheral device, and/or etc. into the electronic device. Thus, a user may need a plurality of different adaptors in order to plug in a plurality of different devices.

BRIEF DESCRIPTION OF THE DRAWINGS

Arrangements and embodiments may be described in detail with reference to the following drawings in which like reference numerals refer to like elements and wherein.

DETAILED DESCRIPTION

In the following detailed description, like numerals and characters may be used to designate identical, corresponding and/or similar components in differing figure drawings. Further, in the detailed description to follow, example sizes/models/values/ranges may be given although embodiments are not limited to the same. Where specific details are set forth in order to describe example embodiments, it should be apparent to one skilled in the art that embodiments may be practiced without these specific details.

Embodiments may use a power adaptor as a modular foundation that may be expanded to provide expanded input/output (I/O) capabilities via expansion modules (or add-on modules). This may eliminate the need for a separate power connector for each external device, may provide power charging, and/or may also provide data transfer/communication between the electronic device and the power adaptor.

As one example, a laptop computer may be coupled to a base modular unit, which may be coupled to a power source. An expansion modular unit may be physically coupled to the base modular unit. The expansion modular unit may be coupled to or provide power to a projector and/or a display in order to provide an image. The expansion modular unit (and/or the projector or display) may be powered based on a power source coupled to the base modular unit. Other expansion modular units may also be physically coupled to the base modular unit and/or another expansion modular unit.

Figure 1:
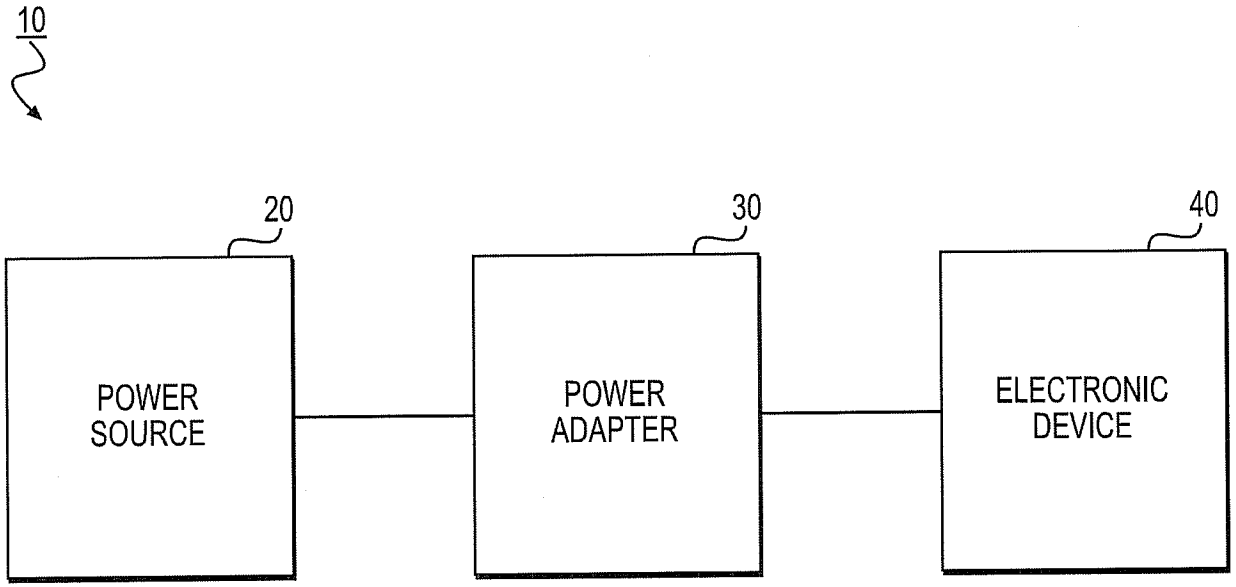
FIG. 1 shows an electronic device powering system according to an example embodiment.

FIG. 1 shows an electronic device powering system according to an example embodiment. Other embodiments and configurations may also be provided.

More specifically, FIG. 1 shows an electronic system 10 that includes a power source 20, a power adaptor 30 (or adaptor) and an electronic device 40. The power source 20 may provide power (such as an alternate current (AC)) to the power adaptor 30. The power adaptor 30 may provide power to the electronic device 40 based on the received power.

As one example, the power adaptor 30 may provide AC power to the electronic device 40. As another example, the power adaptor 30 may provide direct current (DC) power to the electronic device 40. The power adaptor 30 may couple to the electronic device 40 by a cable, a bus, a wire, a plurality of wires, etc. For example, the power adaptor 30 may couple to the electronic device 40 by a Universal Serial Bus (USB).

The electronic device 40 may be any one of a plurality of devices, such as a mobile terminal, a mobile device, a mobile computing platform, a mobile platform, a laptop computer, a tablet, an ultra-mobile personal computer, a mobile Internet device, a smartphone, a personal digital assistant, a display device, a television (TV), etc. Other types of electronic devices may also be provided.

The power adaptor 30 may provide power to/from the electronic device 40. The power adaptor 30 may provide data communication with the electronic device 40. The power adaptor 30 may provide power to the electronic device 40 and/or from the electronic device 40.

Figure 2:
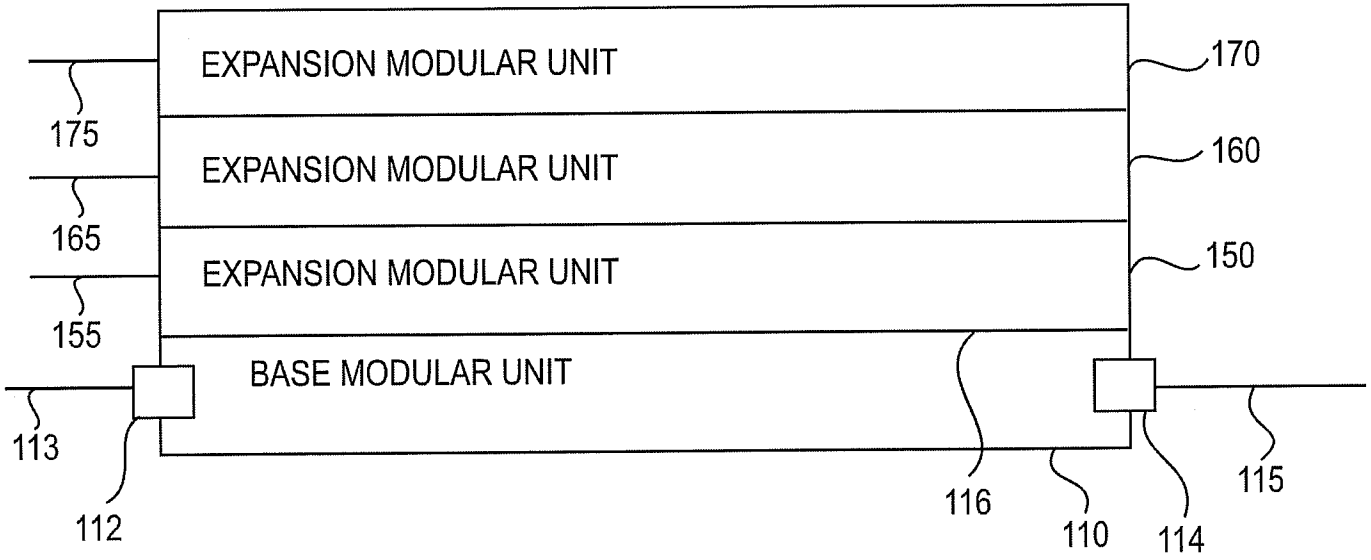
FIG. 2 is a side view of a modular power adaptor according to an example embodiment.

FIG. 2 is a side view of a modular power adaptor according to an example embodiment. Other embodiments and configurations may also be provided.

More specifically, FIG. 2 shows a base modular unit 110 and a plurality of expansion modular units 150, 160, 170. Merely as an example, FIG. 2 shows three expansion modular units. However, other numbers of expansion modular units may also be provided for a modular adaptor (or modular power adaptor).

The base modular unit 110 may include a first port 112 (at a first end) to couple to a first connector device 113 (or first connector). The first connector device 113 may be a cable, a bus, a wire, a plurality of wires, etc. The first connector device 113 may couple to a power source, another electronic device and/or another device, for example.

The base modular unit 110 may also include a second port 114 to couple to a second connector device 115 (or second connector). The second connector device 115 may couple to the electronic device 40 (FIG. 1). The second connector device 115 may be a cable, a bus, a wire, a plurality of wires, etc. The second connector device 115 may couple to a power source, another electronic device and/or another device, for example.

As one example, the second connector device 115 may be a USB cable to couple to a laptop computer, for example.

FIG. 2 shows that the plurality of modular expansion units may be provided on a first surface 116 (i.e., a top surface) of the base modular unit 110. The plurality of modular expansion units may be stacked on the base modular unit 110. The individual stacking of the modular expansion units may allow data communication and/or power distribution among the different modular units.

FIG. 2 shows that a first expansion modular unit 150 is provided on the first surface 116 of the base modular unit 110, a second expansion modular unit 160 is provided on the first expansion modular unit 150, and a third expansion modular unit 170 is provided on the second expansion modular unit 160.

Each of the expansion modular units 150, 160, 170 may have a separate purpose and/or functionality. For example, each of the expansion modular units may separately be one of a display module expander (for HDMI, DP, VGA, s-Video out, etc.), a memory expander (such as SDHC, SD, microSD, etc), a bus port expansion hub, an antenna expansion module for enhancing antenna capabilities and/or etc. Other types of expansion modular units may be provided. Other capabilities or types of expansion modular units may include data storage, a display device (such as a projector), input/output (I/O) expansion modules, wireless access point, SSD or HDD drives expansion, RAID SSD back up drive, wireless phone charger cradle, smartphone dock, card scanner module, etc.

In at least one embodiment, one of the expansion modular units may be for a display or a projector. The display or the projector may receive power from a power source coupled to the base modular unit 110. The display and/or the projector may receive data (or data information) from an electronic device coupled to the base modular unit 110.

Each expansion modular unit may include an identification, such as a code, that may identify a type of the specific expansion modular unit. The identification may allow the base modular unit to make sure that the expansion modular units are compatible and to make sure that incompatible modular units are not connected to the base unit.

As shown in FIG. 2, a connector device 155 may couple to the first expansion modular unit 150. The connector device 155 may couple to another device, such as a peripheral device. The peripheral device may be a display or projector, for example. The connector device 155 may provide bi-directional communication between another device and the first expansion modular unit 150. The connector device 155 may provide power to the another device or receive power from the another device. The connector device 155 may be a cable, a bus, a wire, a plurality of wires, etc.

As shown in FIG. 2, a connector device 165 may couple to the second expansion modular unit 160. The connector device 165 may couple to another device, such as a peripheral device. The peripheral device may be a display or a projector, for example. The connector device 165 may provide bi-directional communication between another device and the second expansion modular unit 160. The connector device 165 may provide power to another device or receive power from the another device. The connector device 165 may be a cable, a bus, a wire, a plurality of wires, etc.

As shown in FIG. 2, a connector device 175 may couple to the third expansion modular unit 170. The connector device 175 may couple to another device, such as a peripheral device. The peripheral device may be a display or a projector, for example. The third connector device 175 may provide bi-directional communication between another device and the third expansion modular unit 170. The connector device 175 may provide power to the another device or receive power from the another device. The connector device 175 may be a cable, a bus, a wire, a plurality of wires, etc.

Figure 3:
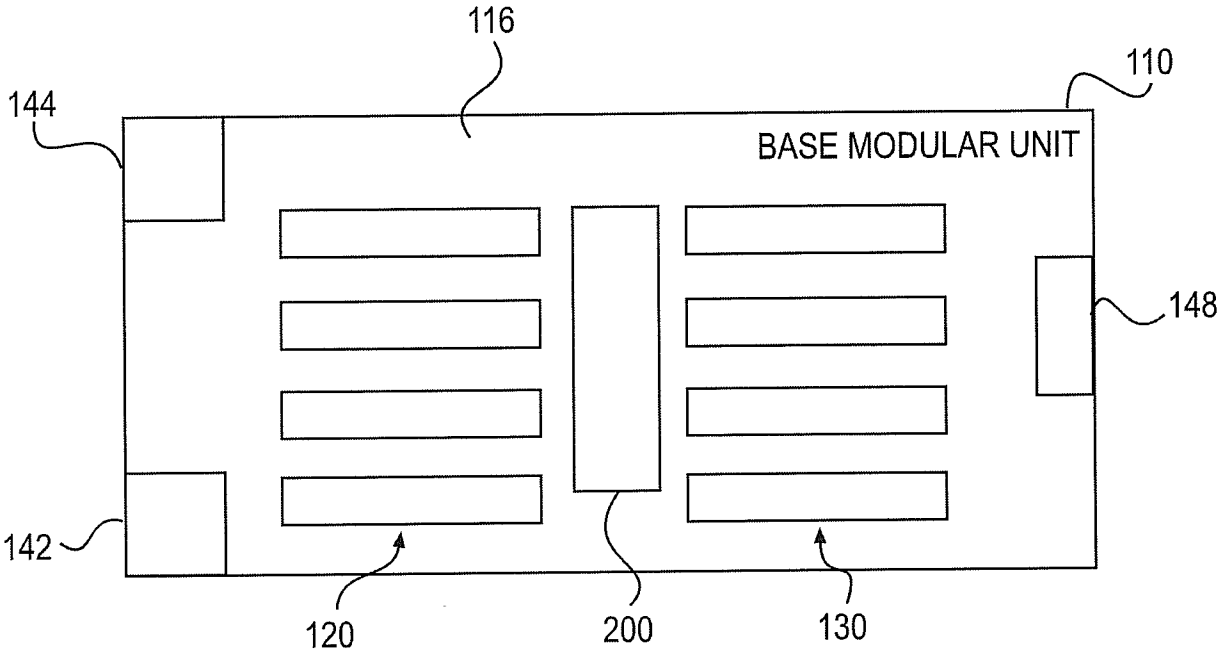
FIG. 3 is a top view of a base modular unit according to an example embodiment.

FIG. 3 is a top view of a base modular unit according to an example embodiment. Other embodiments and configurations may also be provided.

More specifically, FIG. 3 shows the first surface 116 (i.e., the top surface) of the base modular unit 110. Supporters 142 and 144 may be provided at two corner areas of the first surface 116. The supporters 142 and 144 may extend upward from the first surface 116 and help allow an expansion modular unit to be properly provided on the first surface 116 of the base modular unit 110. The supporters 142, 144 may provide physical alignment of the expansion modular units on the base modular unit 110.

A groove connector 148 may be provided at an opposite end of the first surface 116 of the base modular unit 110. The groove connector 148 may include a groove that extends inward from the first surface 116 to receive a protrusion component from the expansion modular unit. The supporters 142, 144 and the groove connector 148 may allow an expansion module unit to snap or lock onto the base modular unit 110. The supporters 142, 144 and the groove connector 148 aid in the mechanical attachment and alignment of the modular units.

The supporters 142, 144 and the groove connector 148 are physical attachment points to secure expansion modular units to the base modular unit (or secure the expansion modular units to other expansion modular units). The supporters 142, 144 and groove connector 148 may compliment and align with other supporters and groove connectors. The supporters 142, 144 and the groove connector 148 may be physical protrusions and/or deformation(s) on a mating module, or may be magnetic type attachment points.

FIG. 3 also shows that the base modular unit 110 may include a first plurality of surface connectors 120 (at the first surface 116) and a second plurality of surface connectors 130 (at the first surface 116). The surface connectors 120, 130 may be made of a conductive material, such as copper.

The first and second plurality of surface connectors 120, 130 may contact with surface connectors (or other type of connectors) on an expansion modular unit (or other device) when the expansion modular unit is provided on the first surface 116 (of the base modular unit 110). The contacting of surface connectors may allow data communication and/or power distribution between the base modular unit and the expansion modular unit (and other expansion modular units).

Surface connectors may be provided on both a top surface and a bottom surface of the base modular unit 110. The surface connectors may be used to provide information to a device external to the modular unit.

The base modular unit 110 may also include circuitry 200 (or logic). The circuitry 200 may include logic, circuits, circuits components, etc. to perform various operations. The circuitry 200 may include a microprocessor, a processor, and/or a controller to perform various operations.

The circuitry 200 may be provided within a housing of the base modular unit 110. The circuitry 200 may be connected to other components of the base modular unit 110. For example, the circuitry 200 may be electrically connected to any one of the first and second surface connectors 120, 130, the first connector device 113 and/or the second connector device 115.

The circuitry 200 may receive identification information from any device coupled to the base modular unit 110. The circuitry 200 may then route data and/or provide power based on a device connected to the base modular unit 110.

As one example, when an expansion modular unit is mounted on a top surface of the base modular unit 110, surface connectors of the base modular unit 110 may contact surface connectors of the expansion modular unit. Identification information may be provided from the expansion modular unit down to the base modular unit. The circuitry 200 (or logic) of the base modular unit 110 may therefore be able to identify a type of the expansion modular unit (or type of device) that is mounted on the base modular unit 110. During use, the circuitry 200 may then route data and/or provide power up to the expansion modular unit (and/or other units).

As one example, the circuitry 200 of the base modular unit 110 may receive display information from an electronic device, such as a laptop computer. The display information may be received on the second connector device 115. The circuitry 200 may route the display information to a specific one or a specific plurality of surface connectors on the base modular unit 110. The routing of the display information may be based on information (such as identification information) previously received at the base modular unit 110. The appropriate surface connector on the expansion modular unit may receive the display information and provide the display information to the connector device. For example, the display information may be provided to a display that is connected to the connector device at the expansion modular unit.

As another example, the circuitry 200 of the base modular unit 110 may receive power from an external device, such as the power source 10. The power may be received on the first connector device 113. The circuitry 200 may route the power to a specific one or a specific plurality of surface connectors on the base modular unit 110. The routing of the power may be based on information (such as identification information) previously received at the base modular unit 110. The appropriate surface connector on the expansion modular unit may receive the power and provide the power to the connector device. For example, the power may be provided to a display that is connected to the connector device of the expansion modular unit.

The circuitry 200 may receive information from a device, perform a specific function and/or provide information to a device. The circuitry 200 may receive information from or provide information to any one of the first surface connectors 120, the second surface connectors 130, the first connector device 113 and the second connector device 115.

The circuitry 200 may be power conversion circuitry. The circuitry 200 may have logic circuitry that optimizes power conversion based on an internal firmware algorithm or based on communication with the host device (i.e., the laptop). Another example may include decreasing or increasing a charge rate based on an available charge time, and/or a local ambient temperature (optimizing charge rate with power dissipation limits). The expansion modules and the base module may function as a modular subsystem. The base modular unit may have logic circuitry to act as a host and orchestrate communication and optimize functionality. Additional circuitry may include features to coordinate communicating among the base modular unit and respective expansion modular units.

Figure 4:
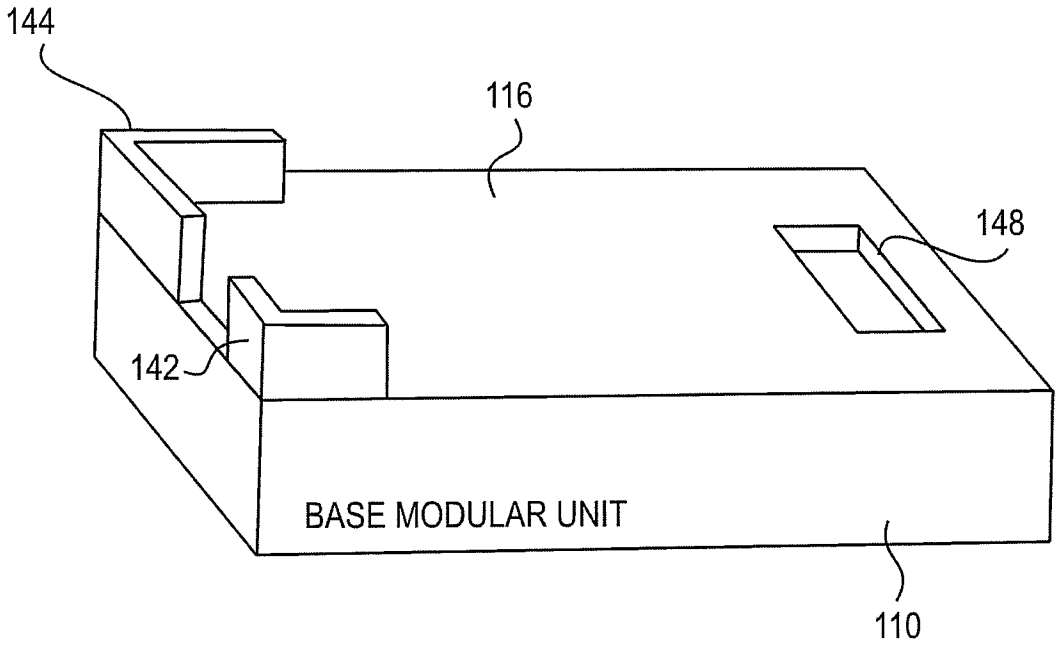
FIG. 4 is a side view of a first portion of a modular base unit according to an example embodiment.

FIG. 4 is a side view of a modular base unit according to an example embodiment. Other embodiments and configurations may also be provided.

More specifically, FIG. 4 shows the first supporter 142 and the second supporter 144 on the first surface 116. The first and second supporter 142 and 144 may extend upwards from the first surface 116. The first and second supporters 142, 144 may support a side of an expansion modular unit provided on the base modular unit 110. The first and second supporters 142, 144 may provide a physical engagement between the base modular unit 110 and an expansion modular unit. The first and second supporters 142, 144 may provide mechanical alignment between the base modular unit 110 and the expansion modular unit provided on the base modular unit 110.

Grooves (or indentations) may be provided at the first and second supporters 142, 144 to receive protrusion components from an expansion modular unit provided on the base modular unit 110. The grooves (or indentations) may provide a physical engagement between the base modular unit 110 and an expansion modular unit. Plastic snaps may also be provided.

FIG. 4 also shows the groove component 148 to receive a protrusion component of an expansion modular unit that is provided on the base modular unit 110. The groove component 148 may provide a physical engagement between the base modular unit 110 and an expansion modular unit. The groove component 148 may provide mechanical alignment between the base modular unit 110 and an expansion modular unit.

The connectors may communicate signals, such as power, ground, detect and data/communication. The connector may be a surface to surface connector or a mechanical attachment. The connectors may be copper or optical connectors.

Figure 5:
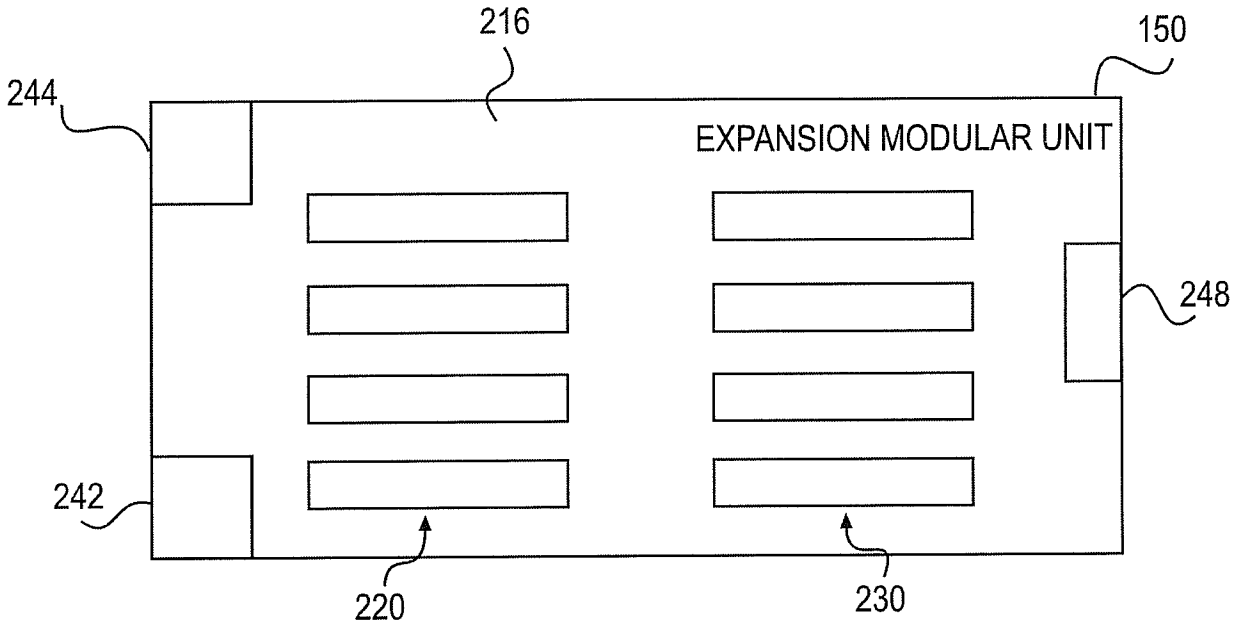
FIG. 5 is a top view of a modular base unit according to an example embodiment.

FIG. 5 is a top view an expansion modular unit according to an example embodiment. Other embodiments and configurations may also be provided.

FIG. 5 may be described with respect to the first expansion modular unit 150. However, the configuration and/or arrangement of FIG. 5 may be applied to any other expansion modular unit. Other arrangements and configurations may also be provided.

More specifically, FIG. 5 shows a first surface 216 (i.e., a top surface) of the expansion modular unit 150. Supporters 242 and 244 may be provided at two corner areas of the first surface 216 (of the expansion modular unit 150). The supporters 242 and 244 may extend upward from the first surface 216 and help allow an expansion modular unit to be properly provided on the first surface 216 of the expansion modular unit 150. The supporters 242, 244 may provide physical alignment of another expansion modular unit on the expansion modular unit 150.

A groove connector 248 may be provided at an opposite end of the first surface 216 of the expansion modular unit 150. The groove connector 248 may include a groove that extends inward from the first surface 216 to receive a protrusion component from another expansion modular unit. The supporters 242, 244 and the groove connector 248 may allow an expansion modular unit to snap or lock onto the expansion modular unit 150. The supporters 242, 244 and the groove connector 248 aid in the mechanical attachment and alignment of the modular units.

The expansion modular unit 150 may also include a first plurality of surface connectors 220 (at the first surface 216) and a second plurality of surface connectors 230 (at the first surface 216). The surface connectors 220, 230 may correspond to the surface connectors 120, 130 discussed above.

The first and second plurality of surface connectors 220, 230 may contact with surface connectors (or other types of connectors) on an expansion modular unit (or other device) when the expansion modular unit 150 is provided on the first surface 216 (of the expansion modular unit 150). The contacting of surface connectors may allow data communication and/or power communication between different modular units.

Surface connectors may also be provided on a bottom surface of the expansion modular unit. The surface connectors on the bottom surface may contact surface connectors of another expansion modular unit or the base modular unit.

The expansion modular unit 150 may also include circuitry and/or logic. The circuitry may include logic, circuits, etc. to perform various operations. The circuitry may include a microprocessor, a processor, and/or a controller to perform various operations.

The circuitry may be provided within a housing of the first expansion modular unit 150. The circuitry may be connected to other components of the first expansion modular unit 150. For example, the circuitry may be electrically connected to any one of the first and second surface connectors 220, 230 and/or the connector device 155.

The circuitry may receive information, perform a specific function and/or provide information to another device. The circuitry may receive information from or provide information to any one of the first surface connectors 220, the second surface connectors 230 and/or the connector device 155.

Figure 6:
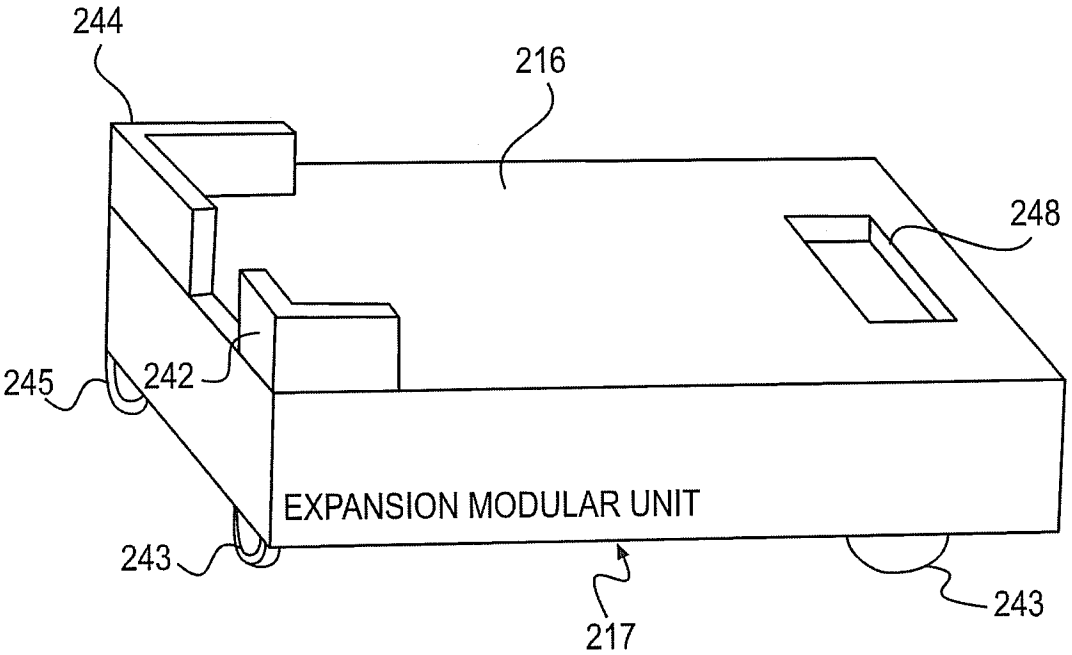
FIG. 6 is a top view of an expansion modular unit according to an example embodiment.

FIG. 6 is a side view of an expansion modular unit according to an example embodiment. Other embodiments and configurations may also be provided.

FIG. 6 may be described with respect to the first expansion modular unit 150. However, the configuration and/or arrangement of FIG. 6 may be applied to any other expansion modular unit. Other arrangements and configurations may also be provided.

More specifically, FIG. 6 shows the first surface 216 (i.e., the top surface) of the expansion modular unit 150. Supporters 242 and 244 may be provided at two corner areas of the first surface 216. The supporters 242 and 244 may extend upward from the first surface 216 and help allow an expansion modular unit to be properly provided on the first surface 216 of the expansion modular unit 150.

A groove connector 248 may be provided at an opposite end of the first surface 216 of the expansion modular unit 150. The groove connector 248 may include a groove that extends inward from the first surface to receive a component from the expansion modular unit. The supporters 242, 244 and the groove connector 248 may allow an expansion module unit to snap or lock onto the expansion modular unit 150.

FIG. 6 also shows protrusion components 243 and 245 that may extend downward from a second surface 217 (or bottom surface) of the expansion modular unit 150. The protrusion components 243, 245 may be provided within indentations of another expansion modular unit or the base modular unit 110.

Additionally, a protrusion component 247 may extend from the second surface 217 of the expansion modular unit 150. The protrusion component 247 may be provided within the groove component of another expansion modular unit or the base modular unit 110. The protrusion components 243, 245 and 247 may aid in the mechanical attachment and alignment of the modular units.

Embodiments may provide a power adaptor as a modular foundation that may be expanded to provide expanded input/output (I/O) capabilities via expansion modules (or add-on modules). This may eliminate the need for a separate power connector for each external device, may provide power charging, and/or may also provide data transfer/communication between the electronic device and the power adaptor.

The expansion modules may be designed for easy mechanical attachment or detachment. Once the expansion modules are provided on a base modular unit, the base modular unit may sense additional functionality and thereby communicate enhanced capability to an electronic device, such as the laptop.

In at least one embodiment, a computer-readable medium may store a program for controlling circuitry or logic of the base modular unit and/or the expansion modular unit. The circuitry may control circuitry or components of the modular units. The program may be used by a controller or a processor, for example. The program may be stored in a memory, which for example, may be internal or external. In at least one embodiment, the program may be part of a control algorithm for controlling operations.

Instructions or code executed by the controller or processor may be provided to a memory from a machine-accessible medium, or an external storage device accessible via a remote connection (e.g. over a network via an antenna and/or network interface) providing access to one or more electronically-accessible media, etc. A machine-accessible medium may include any mechanism that provides (i.e., stores and/or transmits) information in a form readable by a machine (e.g., a computer). For example, a machine-accessible medium may include random access memory (RAM), read only memory (ROM), magnetic or optical storage medium, flash memory devices, electrical, optical, acoustical or other form of propagated signals (e.g., carrier waves, infrared signals, digital signals), etc. In alternative embodiments, hard-wired circuitry may be used in place of or in combination with the instructions or code, and thus the embodiments are not limited to any specific combination of hardware circuitry and software instructions.

The program may include code or instructions to perform any of the operations or functions performed in embodiments previously discussed above.

The following examples pertain to further embodiments.

Example 1 is an adaptor comprising: a base modular unit including: a plurality of surface connectors at one surface of the base modular unit, and at least one surface connector to contact a first expansion modular unit, a first port to receive a first connector device to couple to an electronic device, and logic, at least a portion of which includes hardware, to receive identification information of the first expansion modular unit, and to provide information from the first port to the at least one surface connector based on the received identification information.

In Example 2, the subject matter of Example 1 can optionally include that the base modular unit includes a second port to receive a second connector device.

In Example 3, the subject matter of Example 2 can optionally include that the second connector device to couple to a power source.

In Example 4, the subject matter of Example 3 can optionally include that the power source to provide power to a peripheral device to couple to the first expansion modular unit.

In Example 5, the subject matter of Example 4 can optionally include that the peripheral device is a display device.

In Example 6, the subject matter of Example 4 can optionally include that the logic to provide power from the second port to at least the first expansion modular unit.

In Example 7, the subject matter of Example 1 can optionally include the first expansion modular unit and a second expansion modular unit.

In Example 8, the subject matter of Example 7 can optionally include that the first expansion modular unit includes a plurality of surface connectors.

In Example 9, the subject matter of Example 8 can optionally include that the plurality of surface connectors at the first expansion modular unit to contact the plurality of surface connectors at the base modular unit.

In Example 10, the subject matter of Example 8 can optionally include that the base modular unit includes a supporter to provide physical alignment of the first expansion modular unit on the base modular unit.

In Example 11, the subject matter of Example 10 can optionally include that the base modular unit further includes a groove connector to receive a protrusion component of the first expansion modular unit.

Example 12 is an adaptor comprising: a base modular unit, including: a first port to couple to an electronic device, a second port to couple to a power source, a plurality of surface connectors at one surface of the base modular unit, and at least one surface connector to contact a first expansion modular unit, and logic, at least a portion of which includes hardware, to receive identification information of the first expansion modular unit, and to provide power from the second port to the first expansion modular unit.

In Example 13, the subject matter of Example 12 can optionally include that the first expansion modular unit to couple to a peripheral device.

In Example 14, the subject matter of Example 13 can optionally include that the peripheral device is a display device.

In Example 15, the subject matter of Example 12 can optionally include the first expansion modular unit and a second expansion modular unit.

In Example 16, the subject matter of Example 15 can optionally include that the first expansion modular unit includes a plurality of surface connectors.

In Example 17, the subject matter of Example 16 can optionally include that the plurality of surface connectors at the first expansion modular unit to contact the plurality of surface connectors at the base modular unit.

In Example 18, the subject matter of Example 16 can optionally include that the base modular unit includes a first supporter to provide physical alignment of the first expansion modular unit on the base modular unit.

In Example 19, the subject matter of Example 18 can optionally include that the base modular unit includes a groove connector to receive a protrusion component of the first expansion modular unit.

Example 20 is an adaptor comprising: a base modular unit including: a plurality of surface connectors at one surface of the base modular unit, and at least one surface connector to contact a first expansion modular unit, a first port to receive a first connector device to couple to an electronic device, and means for receiving identification information of the first expansion modular unit, and for providing data from the first port to the at least one surface connector based on the received identification information.

In Example 21, the subject matter of Example 20 can optionally include that the base modular unit includes a second port to receive a second connector device.

In Example 22, the subject matter of Example 21 can optionally include that the second connector device to couple to a power source.

In Example 23, the subject matter of Example 22 can optionally include that the power source to provide power to a peripheral device to couple to the first expansion modular unit.

In Example 24, the subject matter of Example 23 can optionally include that the peripheral device is a display device.

In Example 25, the subject matter of Example 24 can optionally include means for providing power from the second port to the first expansion modular unit.

In Example 26, the subject matter of Example 20 can optionally include the first expansion modular unit and a second expansion modular unit.

In Example 27, the subject matter of Example 26 can optionally include that the first expansion modular unit includes a plurality of surface connectors.

In Example 28, the subject matter of Example 27 can optionally include that the plurality of surface connectors at the first expansion modular unit to contact the plurality of surface connectors at the base modular unit.

In Example 29, the subject matter of Example 27 can optionally include that the base modular unit includes a supporter to provide physical alignment of the first expansion modular unit on the base modular unit.

In Example 30, the subject matter of Example 29 can optionally include that the base modular unit further includes a groove connector to receive a protrusion component of the first expansion modular unit.

Example 31 is an adaptor comprising: a base modular unit including: a first port to couple to an electronic device, a second port to couple to a power source, a plurality of surface connectors at one surface of the base modular unit, and at least one surface connector to contact a first expansion modular unit, and means for receiving identification information of the first expansion modular unit, and for providing power from the second port to the first expansion modular unit.

In Example 32, the subject matter of Example 31 can optionally include that the first expansion modular unit to couple to a peripheral device.

In Example 33, the subject matter of Example 32 can optionally include that the peripheral device is a display device.

In Example 34, the subject matter of Example 31 can optionally include the first expansion modular unit and a second expansion modular unit.

In Example 35, the subject matter of Example 34 can optionally include that the first expansion modular unit includes a plurality of surface connectors.

In Example 36, the subject matter of Example 35 can optionally include that the plurality of surface connectors at the first expansion modular unit to contact the plurality of surface connectors at the base modular unit.

In Example 37, the subject matter of Example 35 can optionally include that the base modular unit includes a first supporter to provide physical alignment of the first expansion modular unit on the base modular unit.

In Example 38, the subject matter of Example 37 can optionally include that the base modular unit includes a groove connector to receive a protrusion component of the first expansion modular unit.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An adaptor comprising:

a base modular unit including:

a plurality of surface connectors at a first surface of the base modular unit, and at least one surface connector to contact a first expansion modular unit;

a first port to receive a first connector device to couple to an electronic device, the first port provided at a second surface of the base modular unit; and logic, at least a portion of which includes hardware, to receive, from the first expansion modular unit, identification information of the first expansion modular unit, and to provide information from the first port at the second surface to the at least one surface connector at the first surface based on the received identification information.

2. The adaptor of claim 1, wherein the base modular unit includes a second port to receive a second connector device.

3. The adaptor of claim 2, wherein the second connector device to couple to a power source.

4. The adaptor of claim 3, wherein the power source to provide power to a peripheral device to couple to the first expansion modular unit.

5. The adaptor of claim 4, wherein the peripheral device is a display device.

6. The adaptor of claim 4, wherein the logic to provide power from the second port to at least the first expansion modular unit.

7. The adaptor of claim 1, further comprising the first expansion modular unit and a second expansion modular unit, the second expansion modular unit to be on the first expansion modular unit such that the first expansion modular unit is provided between the base modular unit and the second expansion modular unit.

8. The adaptor of claim 7, wherein the first expansion modular unit includes a plurality of surface connectors at one surface of the first expansion modular unit.

9. The adaptor of claim 8, wherein the plurality of surface connectors at the one surface of the first expansion modular unit to contact the plurality of surface connectors at the first surface of the base modular unit.

10. An adaptor comprising:

a base modular unit; including:

a first port to couple to an electronic device, a second port to couple to a power source, the second port provided at a first surface of the base modular unit, a plurality of surface connectors at a second surface of the base modular unit, and at least one surface connector to contact a first expansion modular unit, the second surface being different than the first surface, and logic, at least a portion of which includes hardware, to receive, from the first expansion modular unit, identification information of the first expansion modular unit, and to provide power from the second port at the first surface to the first expansion modular unit.

11. The adaptor of claim 10, wherein the first expansion modular unit to couple to a peripheral device.

12. The adaptor of claim 11, wherein the peripheral device is a display device.

13. The adaptor of claim 10, further comprising the first expansion modular unit and a second expansion modular unit, the second expansion modular unit to be on the first expansion modular unit such that the first expansion modular unit is provided between the base modular unit and the second expansion modular unit.

14. The adaptor of claim 13, wherein the first expansion modular unit includes a plurality of surface connectors at one surface of the first expansion modular unit.

15. The adaptor of claim 14, wherein the plurality of surface connectors at the one surface of the first expansion modular unit to contact the plurality of surface connectors at the second surface of the base modular unit.

16. An adaptor comprising:

a base modular unit including:

a plurality of surface connectors at a first surface of the base modular unit, and at least one surface connector to contact a first expansion modular unit;

a first port to receive a first connector device to couple to an electronic device, the first port provided at a second surface of the base modular unit; and means for receiving identification information of the first expansion modular unit, and for providing data from the first port at the second surface to the at least one surface connector at the first surface based on the received identification information.

17. The adaptor of claim 16, wherein the base modular unit includes a second port to receive a second connector device.

18. The adaptor of claim 17, wherein the second connector device to couple to a power source.

19. The adaptor of claim 18, wherein the power source to provide power to a peripheral device to couple to the first expansion modular unit.

20. The adaptor of claim 19, wherein the peripheral device is a display device.

21. An adaptor comprising:

a base modular unit including:

a first port to couple to an electronic device, a second port to couple to a power source, the second port provided at a first surface of the base modular unit, a plurality of surface connectors at a second surface of the base modular unit, and at least one surface connector to contact a first expansion modular unit, the second surface being different than the first surface, and means for receiving identification information of the first expansion modular unit, and for providing power from the second port at the first surface to the first expansion modular unit.

22. The adaptor of claim 21, wherein the first expansion modular unit to couple to a peripheral device.

23. The adaptor of claim 22, wherein the peripheral device is a display device.

* * * * *